United States Patent [19]

Pidgeon

[11] 4,211,522

[45] Jul. 8, 1980

[54] OIL-INJECTED ROTARY COMPRESSORS

[75] Inventor: Howard H. J. Pidgeon, Camborne, England

[73] Assignee: Compair Construction & Mining Limited, Cornwall, England

[21] Appl. No.: 921,499

[22] Filed: Jul. 3, 1978

[30] Foreign Application Priority Data

Jul. 5, 1977 [GB] United Kingdom ..... 28163/77

[51] Int. Cl.[2] ..... F04C 29/02

[52] U.S. Cl. ..... 418/99

[58] Field of Search ..... 418/76, 97, 98, 99, 418/100; 184/6.16

[56] References Cited

U.S. PATENT DOCUMENTS

| | | | |
|---|---|---|---|
| 1,558,620 | 10/1925 | Kagi | 418/97 |
| 3,988,080 | 10/1976 | Takada | 418/98 X |
| 4,080,119 | 3/1978 | Eriksson | 418/100 X |

*Primary Examiner*—Leonard E. Smith

*Attorney, Agent, or Firm*—Mawhinney & Mawhinney & Connors

[57] ABSTRACT

A method of draining oil from a transmission housing, of an oil-injected screw compressor comprising a compressor housing containing rotor means and a transmission housing. A shaft of the compressor extends into the transmission housing from the compressor housing and the transmission housing is underslung relative to the compression housing. The first portion of the compressor intake stroke, or rotation, is prevented from being filled with intake gas such that a depression is created. Said depression is applied via a bore to a sump portion of the transmission housing, so that the absolute pressure differential between the sump and the suction portion of the rotor means draws oil out of the sump and into the rotor spaces. A compressor employing this method of draining oil is also described.

4 Claims, 3 Drawing Figures

OIL-INJECTED ROTARY COMPRESSORS

BACKGROUND OF THE INVENTION

1. FIELD OF THE INVENTION

The invention relates to oil injected rotary compressors, and more particularly to a method of draining oil from a transmission housing, or other chamber, of a compressor from which collected lubricating oil is required to be raised and returned to the rotor chambers.

2. PRIOR ART

When the transmission housing of a gas compressor has been arranged such that its sump is lower than the compressor rotors it has been usual practice to use a mechanical pump to lift the oil out of the transmission housing and return it to the compressor, the lifting action being caused by the creation of a depression or sub-atmospheric pressure at the pump inlet by the pump.

SUMMARY OF THE INVENTION

The present invention provides a method of draining oil from a transmission housing, of a rotary compressor comprising a compressor housing containing rotor means and a transmission housing, a shaft of the compressor extending into the transmission housing from the compressor housing, in which method the first portion of the compressor intake stroke, or rotation, is prevented from being filled with intake gas such that a depression is created said depression being applied via a bore to a sump portion of the transmission housing, so that the absolute pressure differential between the sump and the suction portion of the rotor means draws oil out of the sump and into the rotor means spaces. Thus the compressor rotor means acts as a suction lift pump and eliminate the need for a separate mechanical pump and the cost and complication thereof.

The invention also provides an oil injected rotary compressor comprising a compressor housing containing rotor means and having inlet and outlet ports and a transmission housing, a shaft of the compressor extending into the transmission housing from the compressor housing, in which a blanked off portion of the inlet port is provided such that a nominally closed chamber of steadily increasing volume is formed by the rotor means and the blanked off portion as the rotor means turns from the zero volume position, and an opening is arranged in the blanked off portion which is connected by a bore to the lowermost part of the transmission housing, whereby a suction created in the chamber by rotation of the rotor means will draw oil from the lowermost part of the transmission housing up the bore and into the compressor housing. Further rotation will allow the inlet ports to be uncovered and oil drawn up into the enclosed chamber will be drawn into the rotor intake spaces by the gas being drawn into the machine.

DESCRIPTION OF THE PREFERRED EMBODIMENT

Figure 1:
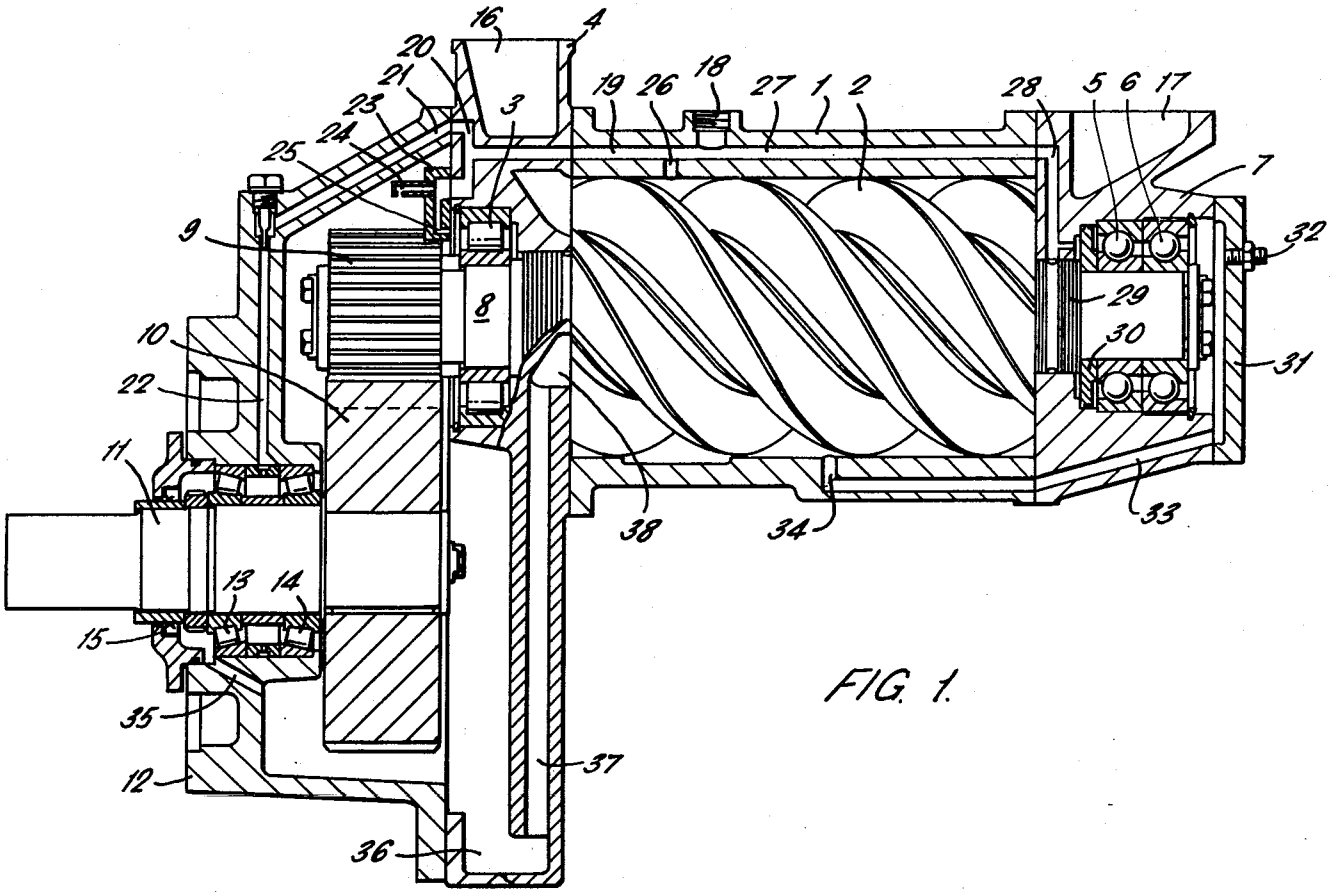
FIG. 1 is a longitudinal section through a screw compressor.

Referring first to FIG. 1, an oil injected screw compresor comprises a rotor housing 1, in which a main rotor, 2, is journalled in bearings 3, 5, & 6. Bearing 3 is provided at the inlet end of the compressor in inlet housing 4 and bearings 5, 6 are provided at the delivery end of the compressor in delivery housing 7.

A gate rotor (not shown) co-operating with the main rotor is also similarly journalled in the housings.

An extension 8 of the main rotor shaft protrudes beyond the inlet housing 4, and the shaft extension 8, carries a toothed pinion 9, which is secured to shaft for rotation therewith.

The pinion 9, is in mesh with a drive gear 10, which is carried on a drive shaft 11, both gears 9 & 10, being located within a transmission housing 12, mounted on the inlet housing 4.

The drive shaft 11 of the compressor is journalled in bearings 13 and 14, in the transmission housing 12, and is sealed where it passes through the transmission housing end wall by a shaft seal 15.

The main rotor 2, is driven, in use, by a prime mover (not shown) drivingly connected to the free end of drive shaft 11.

In use, the main rotor 2, driven as described, and its co-operating gate rotor, cause air (or other gas) to pass through the compressor housing while being compressed, from an inlet aperture 16, to an outlet aperture 17. Compressed air is conveyed from the outlet aperture to a receiver and oil recovery unit (not shown). The receiver also acts as a reservoir for cooling and lubricating oil for the compressor.

The lubricating oil is forced, by the gas pressure in the receiver, into the compressor housing through an aperture 18, whence communicating drillings 19, 20, 21 and 22, convey it to lubricate the bearings 13 & 14. Oil from drilling 20 is also conveyed into a small spray housing 23, from where it is fed through a spray pipe 24 onto the gears 9 and 10, and through an orifice 25, onto bearings 3.

Lubricating and cooling oil for the rotors passes into the rotor housing bore via a drilling 26, whence it is carried out through the outlet aperture 17, with the compressed gas.

Further communicating drillings 27 and 28, convey oil to seals 29 and 30, at the delivery end of the compresser and oil passing these seals lubricates the delivery end bearings 5 and 6. A sufficient leakage of oil past the seals 29 and 30 to effectively lubricate bearings 5 and 6 is always present in use of the compressor.

The oil from bearings 5 & 6, together with a small amount of air which may have leaked across seals 29 and 30, from the delivery end of the rotors, collects in the delivery end cover 31, where it is supplemented by oil reclaimed in the final stage of the oil recovery unit (not shown) which is fed in at connection 32. All the oil collected in the end cover 31, is forced into the rotor casing through drillings 33 and 34, by the expansion of the air which is entrained in the oil.

As can be seen in FIG. 1, the arrangement of the compressor is such that the transmission housing 12 is underslung in respect to the rotor housing 1. Lubricating oil from bearing 13 passes into the transmission housing 12, via a drilling 35. This oil together with lubricating oil from the bearings 3 and 14, and from the gears 9 and 10, falls by gravity to the bottom of the transmission housing 12, and the adjacent portion of the inlet housing 16, where it collects in the region 36.

A passage 37, is provided in the inlet housing 4 and connects the oil collecting region 36 to a suction chamber 38, situated at the face of the inlet housing.

This suction chamber 38, is arranged such that in use, it will be at a substantially subatmospheric pressure, such that the depression will cause oil to be drawn up passage 37, thus removing oil from the transmission housing and transferring it to the rotor inlet spaces. The oil level in the transmission housing 12, will thus always be below the bottom of the gear wheel 10, so preventing generation of heat and the absorbtion of additional power, which would reduce the efficiency of the compressor.

Figure 2:
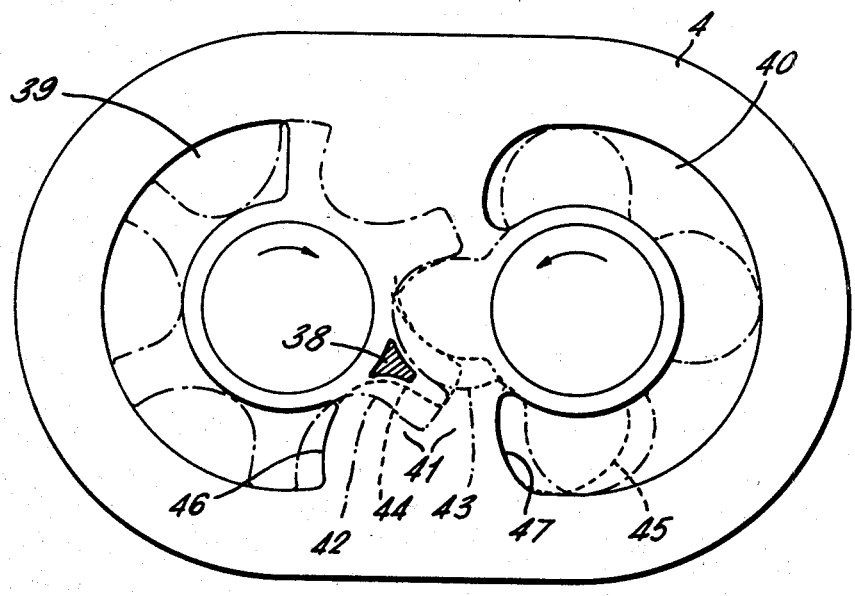
FIG. 2 is a diagram of the face of the inlet casing in elevation showing the gas inlet ports and the suction oil lift port.

FIG. 2 shows a view of the face of the inlet housing 4, including the inlet ports 39 and 40, gate rotor side, main rotor side. These ports 39, 40 are in communication with inlet 16. In normal practice these two ports are joined into one in the area shown at 41. However, in the compressor shown this area is made flush with the rotor casing face such that the end faces of the rotor lobes seal against this face. The end shape of the rotors is shown chain dotted on FIG. 2, at 42, gate rotor and 43, main rotor, in the closed or zero intake volume position.

As the rotors rotate (in the direction of the arrows in FIG. 2) from this position, an expanding volume is enclosed between the rotor lobes as they move across the area 41. The size of the trapped space volume between the rotor lobes will depend on the rotor rotation from the zero volume position and will reach a maximum at the point at which the inlet ports 39 and 40, are opened to that trapped space. For convenience on FIG. 2, this is shown at 75° main rotor rotation (50° gate rotor rotation). The end shape of the rotor lobes in this position are shown dotted at 44, gate rotor, and 45, main rotor. As the rotors continue to rotate from this position, the gate rotor opens the inlet port at edge 46 and the main rotor at edge 47.

Until the rotation of the rotors opens the inlet port at 46, 47, the trapped volume space is substantially sealed from the inlet and is expanded by the rotation of the rotors thus creating a subatmospheric pressure in this space. The chamber 38 communicates with this space and so a suction is created in the chamber 38.

The suction port 38, must be arranged in the vicinity of the generally triangular area double hatched on FIG. 2, and must be bounded on the two upper sides by the end shape of the male lobe at zero volume 43, and the locus of the bottom of the gate rotor flute, and on the bottom side by the flank of the gate rotor at inlet port opening 44, such that the suction chamber 38, is never open to the non trapped spaces of the rotors.

Figure 3:
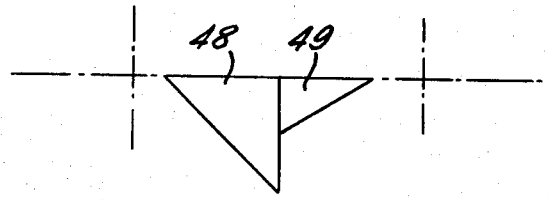
FIG. 3 is a diagram of the face of the inlet casing in plan showing the junction of this face with the rotor bores.

To fully enclose the trapped space volume it will in some cases be necessary to ensure that the rotor bores are fully enclosed by the rotor lobe tips at the port opening position, and this will require that the rotor casing is full bored up to the rotor tip lines at the areas 48 and 49, on FIG. 3.

Since there are working clearances between the rotors and their casings there will be leakage losses across them. The angle of rotation enclosing the trapped space must be sized therefore to allow for these leakages, and still create sufficient depression to lift the required amount of oil through the appropriate height from the transmission housing. It has been found that a main rotor rotation of 75° is more than adequate to lift oil from the illustrated transmission housing position.

The invention is not limited to the embodiment described above and various modifications may be made. For example, the invention is equally applicable to a rotary vane compressor in which use the rotation of the single rotor provides the necessary suction.

I claim:

1. A method of draining oil from a transmission housing, of a rotary compressor comprising a compressor housing containing rotor means and having an inlet for gas to be compressed and a transmission housing, a shaft of the compressor extending into the transmission housing from the compressor housing, in which method the first portion of the compressor intake stroke, or rotation, is prevented from being filled with intake gas such that a depression of lower pressure than inlet pressure is created, said depression being applied via a bore to a sump portion of the transmission housing, so that the absolute pressure differential between the sump and the suction portion of the rotor means draws oil out of the sump and into the rotor means spaces.

2. An oil injected rotary compressor comprising a compressor housing containing rotor means and having inlet and outlet ports and a transmission housing, a shaft of the compressor extending into the transmission housing from the compressor housing, in which a blanked off portion of the inlet port is provided such that a nominally closed chamber of steadily increasing volume is formed by the rotor means and the blanked off portion as the rotor means turns from the zero volume position, and an opening is arranged in the blanked off portion which is connected by a bore to the lowermost part of the transmission housing, whereby a suction created in the chamber by rotation of the rotor means will draw oil from the lowermost part of the transmission housing up the bore and into the compressor housing.

3. A compressor as claimed in claim 2 which is a screw compressor and in which the rotor means comprises co-operating male and female rotors.

4. A compressor as claimed in claim 2 in which the bore comprises a drilling in the compressor housing connecting the lowermost part in the transmission housing to the opening.

* * * * *